US005775621A

United States Patent [19]

Sauber

[11] Patent Number: 5,775,621

[45] **Date of Patent: *Jul. 7, 1998**

[54] COMBINATION REEL CADDY AND STAND FOR CABLE SPOOLS

[75] Inventor: Charles J. Sauber, Virgil, Ill.

[73] Assignee: We Cousins, Inc., Virgil, Ill.

[ * ] Notice: The term of this patent shall not extend beyond the expiration date of Pat. No. Des. 359,899.

[21] Appl. No.: 547,961

[22] Filed: Oct. 25, 1995

Related U.S. Application Data

[63] Continuation of Ser. No. 234,173, Apr. 28, 1994, abandoned.

[51] Int. Cl.[6] ..... B65H 75/40; B65H 16/06

[52] U.S. Cl. ..... 242/391.1; 242/596.7; 242/403.1; 242/129.51

[58] Field of Search ..... 242/129.51, 391, 242/391.1, 596.3, 596.8, 596.7, 397, 557, 403.1

[56] References Cited

U.S. PATENT DOCUMENTS 366,909 7/1887 Wirt ..... 242/391.1
2,441,437 5/1948 Morrone ..... 242/391.1
3,038,676 6/1962 Mayer ..... 242/596.3
3,516,615 6/1970 Wickenberg ..... 242/596.7 X

*Primary Examiner*—John Q. Nguyen
*Attorney, Agent, or Firm*—Leydig, Voit & Mayer, Ltd.

[57] ABSTRACT

A reel caddy and support stand for cable spools of the type having a central drum and enlarged disk-like ends with central openings therein wherein the reel caddy and stand comprises a generally U-shaped bent handle portion having a curved end and elongated leg portions with the leg portions carrying stub spindle members adapted to be received in the spool disk like and central openings and the handle and leg portions providing a hairpin like spring action when the leg portions are spread apart to insert the stubs spindle members into the central openings of the disk ends. Stand leg members project at 90° angles from the stub spindle members so that the spool can be rotated and lifted about the legs and then with the handle portion on the same surface as the ends of the stand legs the spool can be freely rotated for unwinding or winding cable therefrom.

2 Claims, 3 Drawing Sheets

COMBINATION REEL CADDY AND STAND FOR CABLE SPOOLS

This is a continuation of application Ser. No. 08/234,173 filed on Apr. 28, 1994, abandoned.

FIELD OF THE INVENTION

The present invention relates generally to reel carriers for electrical cable spools and more particularly to an improved combination reel caddy and stand for transporting and/or feeding cables or conductors such as used, for example, with cable T.V.

BACKGROUND OF THE INVENTION

With the growing areas of communications, such as cable T.V. networks, conductor cable has to be strung throughout many areas and it is necessary that spools of such cable need to be carried to job sites as well as shifted around at the sites. Separate devices such as hand trucks have been used for hauling cable spools and then reel stands have been set up to receive the spools for rotatable feeding of the cable from the spool stands. Hand carrying devices provided often are difficult to install and when used with hand trucks or carts for hauling spools around they add either more manipulations or time consuming operations.

OBJECTS OF THE INVENTION

Accordingly, it an object of the present invention to provide an improved combination reel caddy and support stand for cable spools which overcomes the difficulties and problems attendant with prior devices and arrangements and yet is relatively light weight, simple to install, saves time, costs and renders transporting of cable spools easy and more convenient.

Another object of the present invention is to provide a spooled cable caddy and support stand which can be easily installed on spools without the need for movable mounting parts, time consuming operations or tools.

It is still another object of the present invention to provide a cable spool caddy and support stand which is essentially unitary in respect to attaching it to the spool and is, therefore, easy to use without having to manipulate any parts needed for assembly and which provides a stable stand for rotatable feeding of cable from the spool.

BRIEF DESCRIPTION OF THE DRAWINGS

Other objects an advantages of the present invention will be apparent from the foregoing description and upon reference to the accompanying drawings in which.

While the invention will be described in connection with a particular preferred embodiment, it will be understood that it is not intended to limit the invention to the particular embodiment. On the contrary, it is intended to cover all alternatives, modifications and equivalents as may be included within the spirit and scope of the invention as defined by the appended claims.

DETAILED DESCRIPTION

Figure 1:
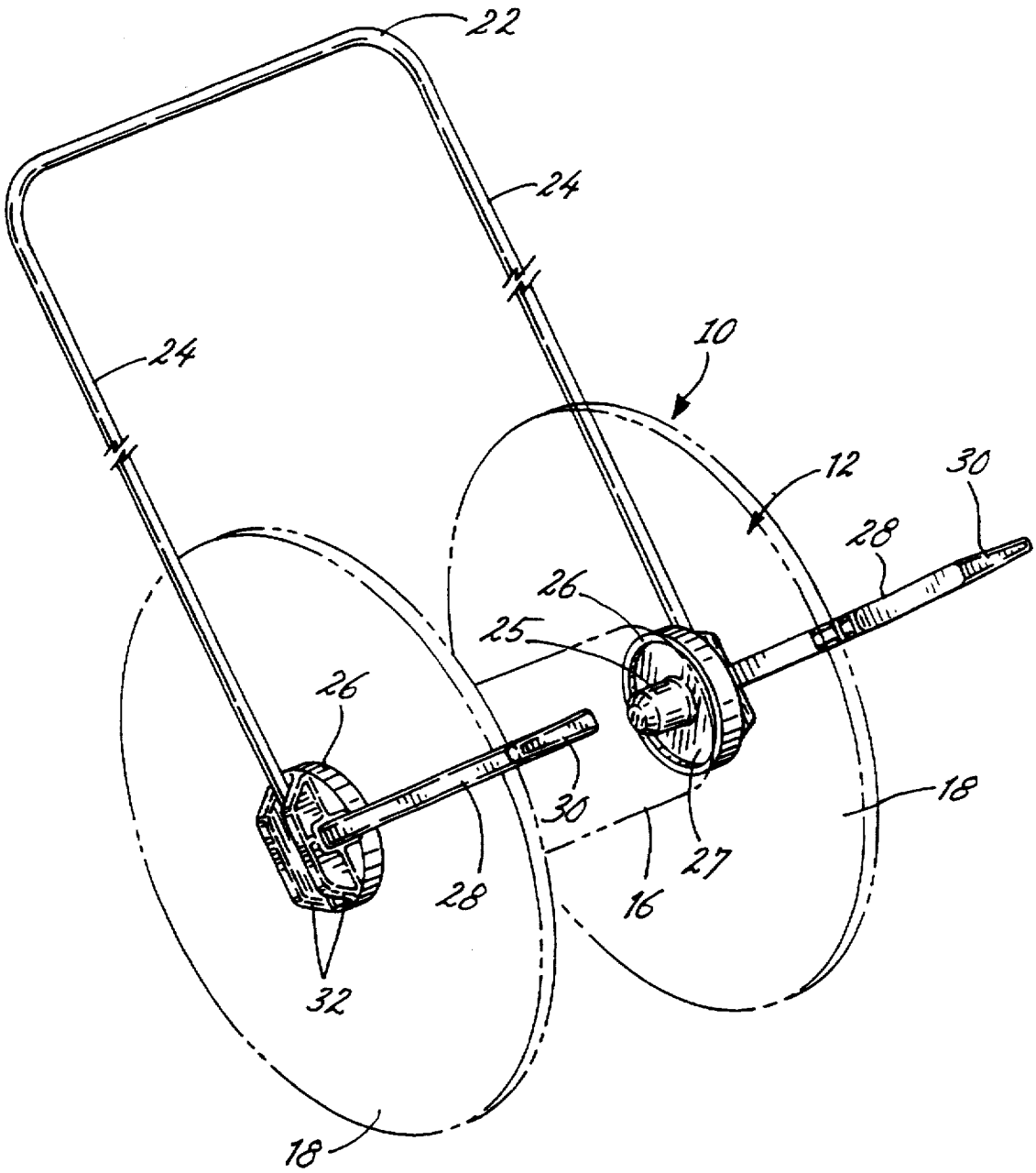
FIG. 1 is a perspective view of a reel caddy and support stand in accordance with the present invention here illustrating its attachment to a cable carrying spool (shown in phantom) for hauling the spool.
Figure 2:
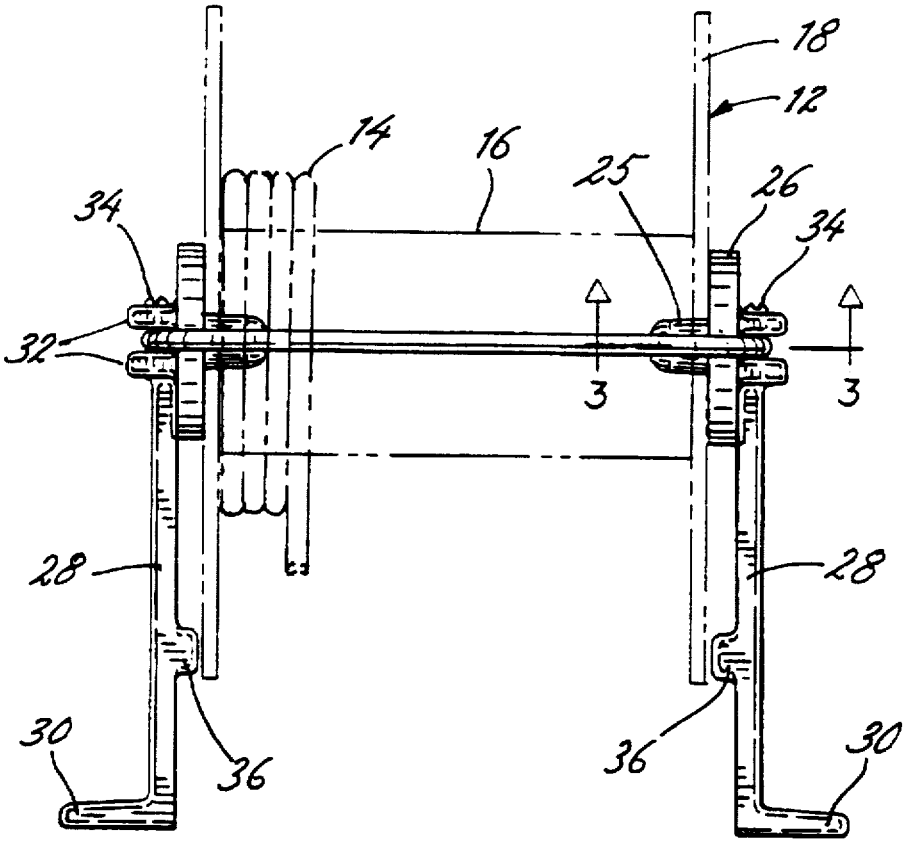
FIG. 2 is a top elevation view of the reel caddy and support shown in FIG. 1.
Figure 3:
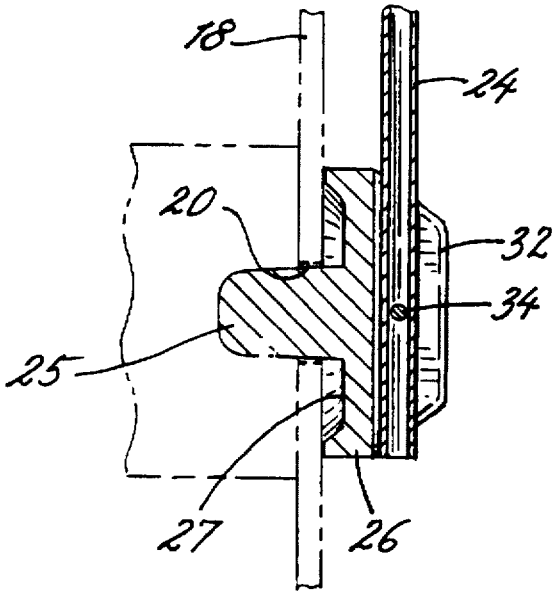
FIG. 3 is a section taken along the line 3—3 in FIG. 2.

Turning now to the drawings, FIG. 1 illustrates the reel caddy and support stand, generally indicated at 10, which is mountable to a cable spool 12 for carrying a conductor cable 14. The spool is of the type generally constructed with a hollow central cylinder 16 and enlarged disk-like ends 18. Openings 20 centrally located in the end disks communicate with the hollow interior of the cylinder 16.

In accordance with the present invention, the reel caddy 10 has a generally U-shaped bent rod handle portion with a curved end 22 and elongated leg portions 24 at the ends of which include spindle 25, collar member 26 and stand legs member 28. The stub spindles 25 are adapted to be received in the openings 20 of the disk-like ends 18 of spool 12. The handle and leg portions are preferably made of aluminum rod which provides suitable durability and strength, and is sufficiently light in weight that it is easily carried. The bent over shape of the handle and legs provides a hairpin like spring action allowing the leg portions to be spread apart to insert the stub spindle 25 ends into the central openings 20 of the spool disk-like ends 18. The biasing action that occurs tending to urge the spindles 25 towards one another holds the reel caddy 10 to the spool with the spool 12 being freely rotatable about the spindle stubs 25 so that the handle pulled in either direction will cause the spool to roll along on the disk edges.

In its preferred arrangement, the present reel caddy is provided principally for communication-type cable that comes wound on spools that are of various widths and diameters. These spool sizes are being widely utilized today with the communication cable and such spooled cable is sufficiently heavy that it is not easily carried around or difficult even for some persons and it is likewise hard to manipulate for unreeling. It will be understood, however, that the cable spool caddy and support stand can be used with considerable variations in size of spools that it will handle and, of course, the reel caddy can be scaled up or down for larger or even smaller reels.

In accordance with another aspect of the present invention, the inside surface 27 of the collars 26 is dished so that the contacting surface with the spool disks is minimized thereby reducing the function and making the rolling of the spools easier.

In accordance with another aspect of the invention, a pair of stand legs 28 are provided which project radially from the spindle collars 26 and end in outwardly bent over ends 30. Each of the legs is angularly positioned, preferably at 90°, with respect to the handle legs 24 and are rigidly secured with respect to the collars 26. The collars 26 include a pair of outwardly projecting spaced flanges 32 which receive the handle leg portions 24 that are held in place by a screw fastener 34. An inwardly projecting lug 36 on each of the legs helps to stabilize and guide a spool when it is in the unreeling stand held position.

Figure 4:
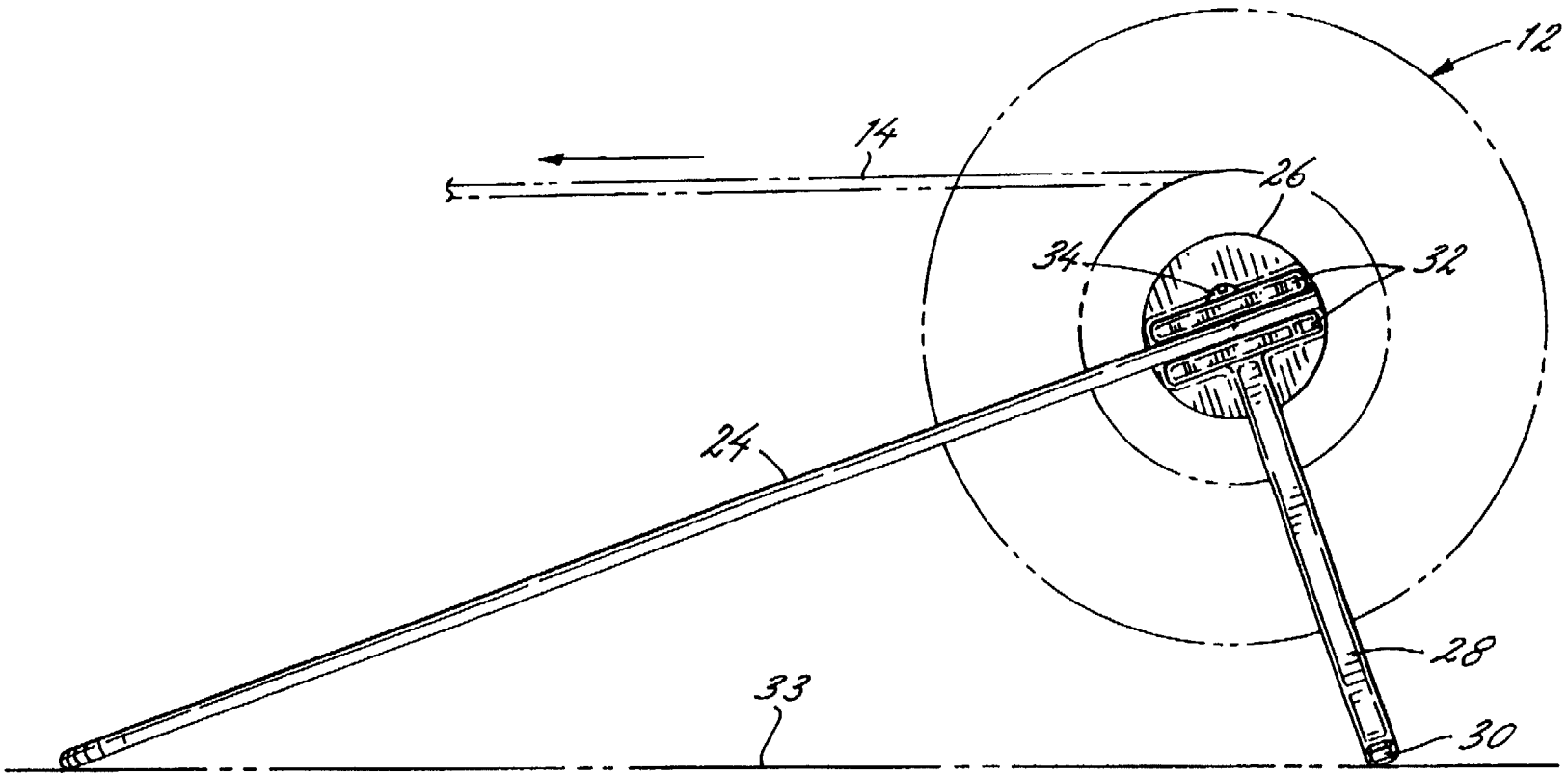
FIG. 4 is a side elevation here showing the positioning for use as the stand for reeling out cable.

Referring to FIG. 4, it will be noted that pushing down upon the handle with the stand legs 28 resting on a surface 33, will cause the spool to be rotated and lifted about the stand legs 28 and with the handle end 22 brought all the way down to the surface, a stable stand is formed which allows the spool to be freely rotated for unreeling cable. Lifting the handle back up will return the spool to the surface and it can then be easily pulled or pushed to roll to another location.

I claim:

1. A combination reel caddy and stand for interchangeable use with cable spools, each cable spool having a central drum member and enlarged disk-like ends with central openings therein, the reel caddy and stand providing for portability of the cable spools over a support surface and for selective suspension of the cable spools above the support surface for unwinding the cable therefrom, the reel caddy and stand comprising: a generally U-shaped bent rod handle having opposed elongated leg portions and a curved end disposed between and joining said leg portions, each of said leg portions carrying a stub spindle member, said stud spindle members being opposed and adapted to be received in the central openings of the spool disk-like ends, each of the leg portions having an end and the ends of the respective leg portions being normally spaced apart and the elongated leg portions and curved end of said handle being formed of a material and disposed with respect to each other so as to allow the leg portions to be resiliently spread apart to interchange the reel caddy and stand between cable spools, the stub spindle members being disposed such that the returning action causes said stub spindle members to be inserted into the central openings of said spool disk-like ends whereby the curved end and leg portions of the handle retain the spool rotatably mounted between the leg portions solely by means of the returning action exerted on said stub spindle members and for rolling the spool on a support surface by movement of the handle parallel to the support surface and wherein an angularly extending stand leg projects radially from each of the stub spindle members for a distance greater than the radius of the disk-like ends of said spool, said stand legs being selectively engageable with said support surface to provide a pivot point for rotation of said handle and the attached spool about said pivot point to a position where said curved end of said handle and said stand legs each engage said support surface to supportingly suspend said spool above said support surface to allow for free rotation of said spool for unwinding the cable therefrom, and each stub spindle member including a collar with the inside surface of the collar being dished surrounding the stub spindle member.

2. A reel caddy and stand as claimed in claim 1 wherein each of said stand legs includes a lug projecting toward the other stand leg.

* * * * *